United States Patent [19]

Shingu et al.

[11] 4,373,950

[45] Feb. 15, 1983

[54] PROCESS OF PREPARING ALUMINUM OF HIGH PURITY

[75] Inventors: Hideo Shingu, Kyoto; Kozo Arai; Ryotatsu Ootsuka, both of Osaka, all of Japan

[73] Assignee: Showa Aluminium Kabushiki Kaisha, Osaka, Japan

[21] Appl. No.: 195,125

[22] Filed: Oct. 8, 1980

[30] Foreign Application Priority Data

Oct. 9, 1979 [JP] Japan ..... 54-130505
Apr. 11, 1980 [JP] Japan ..... 55-48259

[51] Int. Cl.[3] ..... C22B 21/06

[52] U.S. Cl. ..... 75/68 R; 164/71.1; 164/501; 164/900

[58] Field of Search ..... 75/68 R; 164/71.1, 501, 164/900

[56] References Cited

U.S. PATENT DOCUMENTS 3,543,531 12/1970 Adams ..... 75/68 R
3,902,544 9/1975 Flemings et al. ..... 75/135

FOREIGN PATENT DOCUMENTS 616810 1/1949 United Kingdom ..... 164/71.1
214753 5/1968 U.S.S.R. ..... 164/71.1

*Primary Examiner*—M. J. Andrews

[57] ABSTRACT

In melting aluminum containing impurities which form a eutectic with the aluminum and solidifying the molten aluminum by cooling, the aluminum is purified by breaking down dendrites extending from the liquid-solid interface into the liquid phase to release impurities from between the dendrites or between the branches of the dendrites, and dispersing the released impurities in the entire body of the liquid phase.

5 Claims, 5 Drawing Figures

PROCESS OF PREPARING ALUMINUM OF HIGH PURITY

BACKGROUND OF THE INVENTION

This invention relates to a process for purifying aluminum, and more particularly to a process for purifying aluminum containing impurities which form a eutectic with the aluminum to selectively obtain a fraction of higher purity.

Throughout the specification, the term "smooth" refers to the state of a surface which is completely smooth and also to that of a surface having some minute irregularities.

When aluminum containing impurities, such as Fe, Si, Cu, Mg, etc., which form a eutectic with aluminum is melted and then solidified at one end of the molten body, an aluminum fraction of high purity instantaneously separates out at the smooth interface between the liquid phase and the solid phase of the aluminum. Since the impurities are released into the liquid phase at the liquid-solid interface and become thereby concentrated, solidification thereafter proceeds through the growth of dentrites at the interface. The impurities released at the interface form crystals as such, or form eutectic crystals of several microns, between the dendrites or between the branches of dendrites. Accordingly such impure aluminum can be purified effectively by separating primary crystals or a pro-eutectic fraction of aluminum only from the aluminum in a molten state. U.S. Pat. No. 3,311,547, No. 3,671,229, No. 3,163,895 disclose processes for purifying aluminum by utilizing this procedure. With the process disclosed in U.S. Pat. No. 3,211,547, molten aluminum of low impurity is placed in a container opened at its upper end and maintained at a temperature higher than but close to the solidifying point of the melt. The melt is then cooled at its surface to form pro-eutectic aluminum. The pro-eutectic settles on the lower portion of the container, and the pro-eutectic deposit is compacted by suitable means to a block, which is separated from the mother liquor for recovery. Thus the purifying process requires the cumbersome procedure of compacting the whole deposit of the pro-eutectic with suitable means while accurately controlling the temperature of the melt. With the processs disclosed in U.S. Pat. No. 3,671,229, a cooled body is immersed in a melt of impure aluminum to form on the surface of the cooled body a pro-eutectic of aluminum, which is intermittently scraped off and caused to settle on the lower portion of the container. By suitable means, the pro-eutectic deposit is compacted to a block, which is finally collected. This process, like the foregoing process, also requires the procedure of periodically compacting the deposit and is therefore cumbersome. According to the process disclosed in U.S. Pat. No. 3,163,895, molten aluminum in a mold for continuously casting aluminum is agitated by a stirrer in the vicinity of the liquid-solid interface. Although capable of purifying the aluminum to some extent, this process involves a limitation on the purification efficiency.

SUMMARY OF THE INVENTION

The present invention provides a process for purifying aluminum free of the foregoing drawbacks. Stated more specifically, in melting aluminum containing impurities and solidifying the molten aluminum by cooling, the invention provides a process for purifying the aluminum which comprises the steps of breaking down dendrites extending from the interface between the liquid phase and the solid phase of the aluminum into the liquid phase to release impurities from between the dendrites or between the branches of the dendrites, and dispersing the released impurities in the entire liquid phase. This process readily affords aluminum of higher purity than conventional processes.

According to the invention, molten aluminum placed in a ladle is cooled in a mold communicating with an opening formed in the peripheral wall or bottom wall of the ladle, and at the same time, the solidified portion of aluminum is withdrawn from the mold sidewise or downward. Alternatively molten aluminum placed in a crucible is solidified with the use of a seed crystal of pure aluminum immersed in the melt, by slowly withdrawing the seed crystal upward therefrom, causing the molten aluminum to continuously grow into a solid portion integral with the seed crystal. Further alternatively molten aluminum placed in a crucible is solidified by cooling the crucible from below.

When the dendrites extending into the liquid phase from the liquid-solid interface for solidifcation are broken down, the broken dendrites melt again, with the result that the impurities and eutectic of impurities and aluminum held between the dendrites or branches thereof are released into the liquid phase, consequently increasing the concentration of impurities in the liquid phase in the vicinity of the interface. When the melt of aluminum is solidified while dispersing the impurities and eutectic in the entire body of liquid phase, the formation of dendrites at the interface can be inhibited, permitting the melt to solidify while maintaining a smooth interface. With the progress of solidification, however, dendrites are likely to occur again at the interface, in which case impurities will be captures in between the dendrites or between branches thereof. If the dendrites are then broken down to liberate the impurities into the liquid phase and disperse the impurities in the entire liquid phase, solidification will proceed with a smooth interface again. Through repetition of such behavior, the melt of aluminum solidifies while maintaining a smooth interface at all times, affording an aluminum fraction of high purity.

The dendrites extending into the liquid phase from the liquid-solid interface are broken down, for example, by ultrasonic vibration given to the dendrites by an ultrasonic vibrator element, or by a stirrer having propeller blades positioned in contact with the liquid-solid interface.

The ultrasonic vibration is given to the dendrites continuously or intermittently. When the ultrasonic vibration is given continuously, there is the likelihood that some of the impurities released into the liquid phase from the broken dendrites will be forced against the interface, possibly presenting difficulties in completely dispersing the impurities in the entire liquid phase. This problem will not arise when the vibration is given intermittently. It is therefore preferable to provide the ultrasonic vibration intermittently.

The impurities released into the liquid phase is dispersed in the entire body of liquid phase, for example, by stirring the liquid phase. The liquid phase is stirred, for example, with a stirrer. When molten aluminum placed in a crucible with an upper opening is solidified with use of a seed crystal of pure aluminum having a lower end immersed in the melt by raising the seed crystal, the liquid phase may be stirred by rotating the seed crystal. When dendrites are broken down by a stirrer with its propeller blades positioned in contact with the liquid-solid interface, the liquid phase can be stirred at the same time by the rotation of the blades, hence efficient.

The present invention will be described below in greater detail with reference to the accompanying drawings.

DESCRIPTION OF THE PREFERRED EMBODIMENTS

Figure 1:
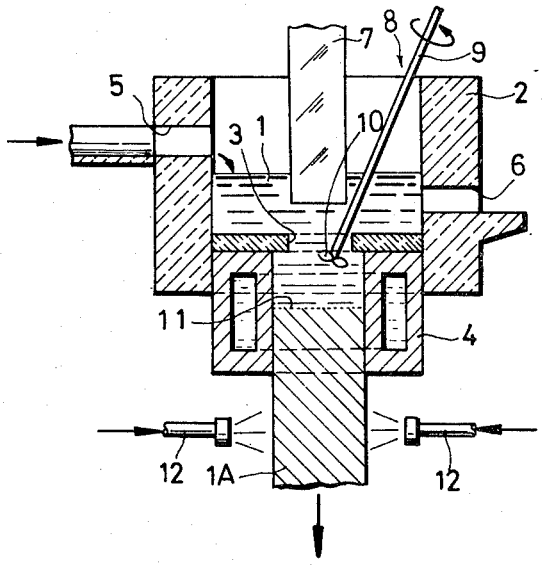
FIG. 1 is a view in vertical section showing a first embodiment of the apparatus for practicing the process of this invention for purifying aluminum.

With reference to FIG. 1 showing a first embodiment for use in the process of this invention for purifying aluminum, the molten aluminum 1 to be purified and containing impurities which form a eutectic with aluminum is placed in a ladle 2 having an opening 3 in its bottom wall. In communication with the opening 3 is a mold 4 adapted to be water-cooled internally and disposed outside the ladle 2. The ladle 2 has a peripheral wall formed with a melt inlet 5 and a residue outlet 6 disposed at a slightly lower level than the inlet 5. The residue outlet 6, which is normally closed, is provided for discharging a highly impure portion of the aluminum 1 remaining in the ladle 2 after a fraction of high purity has been withdrawn on solidification. An ultrasonic vibrator element 7 has a lower end immersed in the molten aluminum. The element 7 extends downward into the ladle 2 through the opening 3. A stirrer 8 disposed in the ladle 2 comprises a rotary shaft 9 extending from above the ladle 2 obliquely into the mold 4 through the opening 3, stirring blades 10 attached to the lower end of the shaft 9 and disposed within the mold 4, and unillustrated drive means. The stirring blades 10 are positioned below the ultrasonic vibrator element 7. Pipes 12 for discharging a cooling fluid are disposed below the mold 4. When the molten aluminum 1 is continuously supplied through the ladle opening 3 into the mold 4 immediately below the ladle 2 and cooled by the mold 4, a liquid-solid interface 11 is formed within the mold 4. When a solidified portion 1A of aluminum is withdrawn downward from the mold 4, the element 7 gives ultrasonic vibration to the interface 11, while the stirrer 8 agitates the liquid phase, whereby dendrites extending into the liquid phase from the interface 11 are broken down. The impurities captured in between the dendrites are thereby released into the liquid phase and dispered into the entire body of the liquid phase. Consequently the liquid phase continuously solidifies while maintaining a smooth liquid-solid interface.

Figure 2:
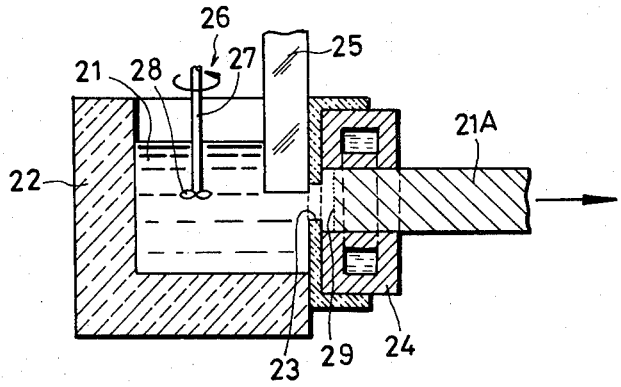
FIG. 2 is a view in vertical section showing a second embodiment of the apparatus for practicing the present process.

With reference to FIG. 2 showing a second embodiment of the apparatus, the molten aluminum 21 to be purified is placed in a ladle 22 having an opening 23 in its peripheral wall. In communication with the opening 23 is a mold 24 adapted to be internally cooled with water and disposed outside the ladle 22. An ultrasonic vibrator element 25 extending along one side wall of the lade 22 has a lower end positioned at part of the opening 23. A stirrer 26 disposed close to the center of the ladle 22 has a lower end immersed in the melt 21. The stirrer 26 comprises a rotatably vertical shaft 27, stirring blades 28 attached to the lower end of the shaft 27 and unillustrated drive means. Although unillustrated, the ladle 22 has a melt inlet and a residue outlet. When the molten aluminum 21 is continuously fed to the mold 24 on one side of the ladle, a liquid-solid interface 29 occurs within the mold 24 first. When the solid aluminum portion 21A is withdrawn sidewise from the mold 24, the element 25 gives ultrasonic vibration to the interface 29, while the stirrer 26 agitates the liquid phase. The melt continuously solidifies with the interface remaining smooth at all times as is the case with the apparatus shown in FIG. 1.

Figure 3:
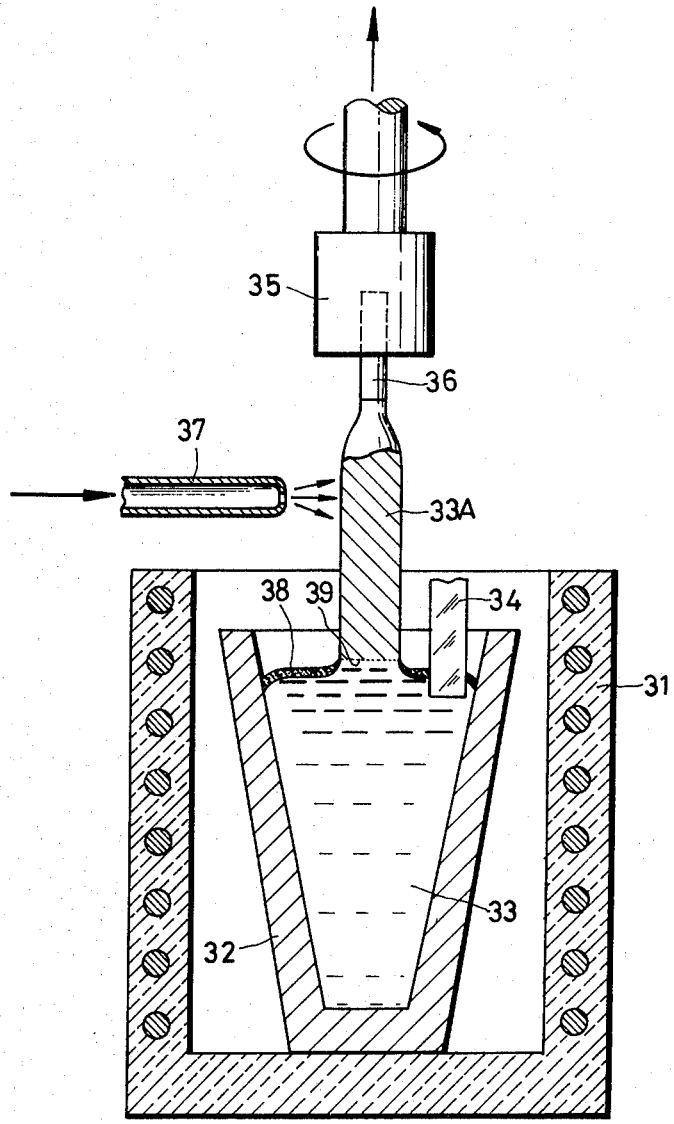
FIG. 3 is a view in vertical section showing

With reference to FIG. 3 showing a third embodiment, a bottomed vertical tubular electric furnace 31 houses a graphite crucible 32 containing the molten aluminum to be purified as at 33. An ultrasonic vibrator element 34 has a lower end immersed in the melt 33. Provided outside the electric furnace 31 above the crucible 32 is a chuck 35 which is rotatable and movable upward and downward for holding a seed crystal 36 made of aluminum of high purity. Disposed some distance above the furnace 31 is a cooling gas discharge pipe 37 having a forward end directed toward the path of vertical movement of the chuck 35. The molten aluminum 33 is covered with a flux 38 floating on its surface for preventing the surface of the melt 33 to form an oxide coating, which, if formed, would be incorporated into the liquid-solid interface to inhibit the growth of aluminum crystals, when the seed crystal 36 is placed into contact with the melt 33 and thereafter withdrawn therefrom to cause the liquid phase to solidify integrally with the seed crystal as will be stated later. Examples of useful materials as the flux 38 comprise a chloride and/or fluoride and are floatable on the surface of the melt 33. With this apparatus, the melt 33 is maintained at a predetermined temperature, and the chuck 35 is lowered to bring the seed crystals 36 into contact with the melt 33 through the flux 38, whereon the molten portion of aluminum 33 starts to form aluminum crystals on the under surface of the seed crystal 36. When the chuck 35 is thereafter raised while in rotation, the melt continuously grows into a solid portion integral with the seed crystal 36, affording solid aluminum 33A. When the element 34 gives ultrasonic vibration to the interface 39 at this time, the dendrites extending into the liquid phase from the interface 39 are broken down to release impurities from between the dendrites. The rotation of the seed crystal 36 due to the rotation of the chuck 35 disperses the impurities in the whole body of liquid phase. Consequently the melt continuously solidifies to highly pure solid aluminum 33A integral with the seed crystal 36, with the interface 29 remaining smooth at all times.

Figure 4:
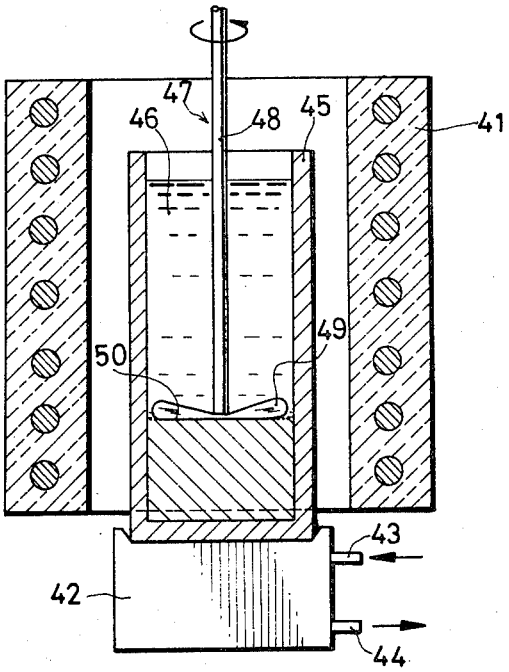
FIG. 4 is a view in vertical section showing a fourth embodiment of the apparatus for practicing the present process.

With reference to FIG. 4 showing a fourth embodiment of the apparatus, a vertical tubular electric furnace 41 having opposite open ends is provided with a chill 42 positioned a small distance below its open lower end. A cooling water inlet duct 43 and a cooling water outlet duct 44 are connected to one side wall of the chill 42. Cooling water is led into the chill 42 through the inlet duct 43, then circulated through the interior of the chill 42 and thereafter run off from the outlet 44, whereby the chill 42 is internally cooled. Placed on the chill 42 is a hollow cylindrical graphite crucible 45 containing the molten aluminum 46 to be purified. The graphite crucible 45 is housed almost entirely within the furnace 41. A stirrer 47 disposed close to the center of the crucible 45 comprises a vertical rotary shaft 48, propeller blades 49 attached to the lower end of the shaft 48 and unillustrated drive means. The path of revolution of the forward ends of the blades 49 has a diameter approximately equal to the inside diameter of the crucible 45.

With this apparatus, the molten aluminum 46 is cooled from below by the chill 42, and nucleation takes place first on the bottom of the crucible 45, instantaneously forming a smooth liquid-solid interface 50. Dendrites develop at the interface 50. The stirrer 47 is subjected to the desired load from thereabove, and the stirring blades 49 are driven with their lower edges in contact with the interface 50. This breaks down the dentrites extending from the interface 50 into the liquid phase, releasing impurities and eutectic of impurities from between the dendrites into the liquid phase. At the same time, the released impurities and eutectic are forced upward by the blades 49 and dispersed in the entire body of the liquid phase. With the progress of solidification, the stirring blades 49 are gradually raised while being held in contact with the interface 50 at all times.

Figure 5:
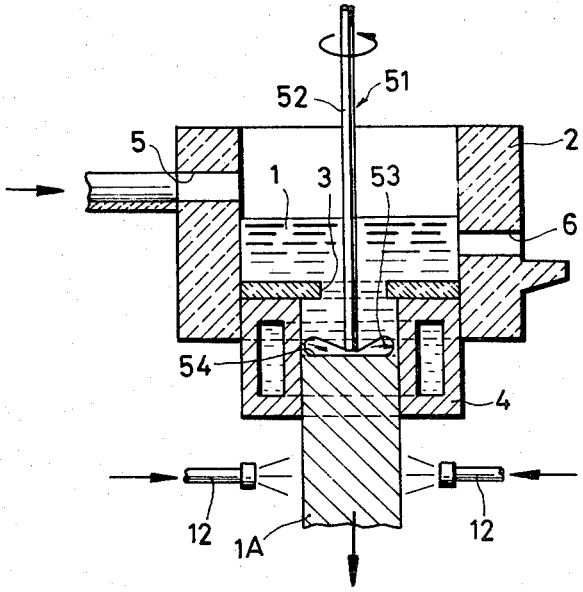
FIG. 5 is a view in vertical section showing a fifth embodiment of the apparatus for practicing the present process.

With reference to FIG. 5 showing a fifth embodiment, the same parts as those shown in FIG. 1 are referred to by the same corresponding reference numerals. In FIG. 5, a stirrer 51 is provided close to the center of a ladle 2. The stirrer 51 comprises a rotary shaft 52 having a lower end extending through an opening 3 into a mold 4, propeller blades 53 attached to the lower end of the shaft 52 and positioned within the mold 4, and unillustrated drive means. The circular path of revolution of the forward ends of the blades 53 is approximately equal to the inside diameter of the mold 4. When molten aluminum 1 is continuously fed through the opening 3 of the ladle 2 into the mold 4 therebelow and cooled by the mold 4, a liquid-solid interface is formed within the mold 4 first. When the solid aluminum portion 1A is withdrawn downward from the mold 4, the stirrer 51 is subjected to the desired load from thereabove, and the stirring blades 53 are driven with their lower edges held in contact with the interface 54. This breaks down dentrites extending from the interface 50 into the liquid phase, whereby impurities are released from between the dendrites or branches thereof into the liquid phase and, at the same time, are dispersed throughout the entire liquid phase. As a result, the melt progressively solidifies while permitting the interface 54 to remain smooth at all times.

EXAMPLE 1

Aluminum was purified using the apparatus shown in FIG. 1. The molten aluminum 1 to be purified and containing 0.12 wt.% of Fe and 0.04 wt.% of Si was placed in the ladle 2. The solid aluminum portion 1A was withdrawn downward at a rate of 3 mm/min. while cooling the melt with the mold 4. At this time, the ultrasonic vibrator element 7 continuously gave ultrasonic vibration to the interface 11 at 30 KHz, and the liquid phase was agitated by the stirrer 8. When checked for average impurity concentration, the cast body thus obtained was found to contain 0.072 wt.% of Fe and 0.02 wt.% of Si.

EXAMPLE 2

The same molten aluminum as treated in Example 1 was purified by the same apparatus in the same manner except that ultrasonic vibration was applied intermittently at 30 KHz for 5 seconds at a time at an interval of 3 seconds. When examined for average impurity concentration, the cast body obtained was found to contain 0.01 wt.% of Fe and 0.012 wt.% of Si.

EXAMPLE 3

Aluminum was purified using the apparatus shown in FIG. 2. The molten aluminum 21 to be purified and containing 0.12 wt.% of Fe and 0.04 wt.% of Si was placed in the lade 22. The solid aluminum portion 21A with withdrawn sidewise at a rate of 3 mm/min. while cooling the melt with the mold 24. During operation, the vibrator element 25 gave ultrasonic vibration to the interface 29 at 100 KHz intermittently for 5 seconds at a time at an interval of 3 seconds, and the liquid phase was agitated by the stirrer 26. When checked for average impurity concentration, the cast body thus obtained was found to contain 0.018 wt.% of Fe and 0.016 wt.% of Si.

EXAMPLE 4

Aluminum was purified using the apparatus of FIG. 3. The molten aluminum 33 to be purified and containing 0.12 wt.% of Fe and 0.04 wt.% of Si was placed in the graphite crucible 32 while being maintained at 700° C. A seed crystal 36 was immersed in the melt 33 and thereafter withdrawn at a rate of 3 mm/min. while being driven at 400 r.p.m. At the same time, ultrasonic vibration was given at 50 KHz to the interface continuously by the vibrator element 34. When checked for average impurity concentration, the cast body obtained was found to contain 0.028 wt.% of Fe and 0.022 wt.% of Si.

EXAMPLE 5

The same molten aluminum as treated in Example 4 was purified by the same apparatus in the same manner as in Example 4 except that ultrasonic vibration was applied at 50 KHz intermittently for 5 seconds at a time at an interval of 3 seconds. When checked for average impurity concentration, the cast body obtained was found to contain 0.008 wt.% of Fe and 0.010 wt.% of Si.

EXAMPLE 6

Aluminum was purified using the apparatus of FIG. 4. The molten aluminum 46 to be purified and containing 0.08 wt.% of Fe and 0.006 wt.% of Si was placed in the graphite crucible 45. The melt was solidified with the chill 42 from the bottom upward at a rate of 2 mm/min. while driving the propeller blades 49 at 300 r.p.m. in contact with the interface 50. When about 70% of the whole melt was solidified, the blades 49 were withdrawn to complete the operation. About 70% portion of the cast body from its lower end was cut off from the body and was checked for average impurity concentration to find that the portion contained 0.03 wt.% of Fe and 0.03 wt.% of Si. For reference, the remaining portion of the cast body was similarly checked. It was found to contain 0.2 wt.% of Fe and 0.14 wt.% of Si.

EXAMPLE 7

Under the same conditions as in Example 6, a cast body was obtained from the molten aluminum 46 to be purified and containing 0.03 wt.% of Fe and 0.03 wt.% of Si. About 70% portion of the body from its lower end was cut off from the body and checked for average impurity concentration to find that the portion contained 0.005 wt.% of Fe and 0.006 wt.% of Si.

EXAMPLE 8

Aluminum was purified using the apparatus shown in FIG. 5. The molten aluminum 1 to be purified and containing 0.08 wt.% of Fe and 0.06 wt.% of Si was placed in the ladle 2. The solid aluminum portion 1A was withdrawn downward at a rate of 5 mm/min. while cooling the melt with the mold 4. During operation, the propeller blades 53 were driven at 500 r.p.m. in contact with the interface 54. When checked for average impurity concentration, the cast body was found to contain 0.04 wt.% of Fe and 0.04 wt.% of Si.

COMPARISON EXAMPLE 1

The procedure of Example 1 was repeated to continuously prepare cast aluminum bodies under the same conditions as in Example 1 with the exception of the following three conditions with respect to stirring and application of ultrasonic vibration.

(a) The solid aluminum portion was withdrawn without mechanically stirring the liquid phase in the vicinity of the liquid-solid interface and without giving ultrasonic vibration to the interface. (Body (a).)

(b) The solid aluminum portion was withdrawn while mechanically stirring the liquid phase in the vicinity of the interface. (Body (b).)

(c) The solid aluminum portion was withdrawn while giving ultrasonic vibration at 30 KHz continuously to the interface. (Body (c).)

The bodies obtained were found to have the following average impurity concentrations

| Body | Fe (wt. %) | Si (wt %) |
|---|---|---|
| (a) | 0.12 | 0.04 |
| (b) | 0.1 | 0.036 |
| (c) | 0.09 | 0.030 |

COMPARISON EXAMPLE 2

The procedure of Example 3 was repeated except that no ultrasonic vibration was given to the interface (while similarly stirring the liquid phase in the vicinity of the interface). The cast body was found to contain 0.11 wt.% of Fe and 0.035 wt.% of Si.

COMPARISON EXAMPLE 3

The procedure of Example 4 was repeated without the application of ultrasonic vibration. The cast body was found to contain 0.081 wt.% of Fe and 0.030 wt.% of Si.

This invention may be embodies differently without departing from the spirit and basic features of the invention. Accordingly the embodiments herein disclosed are given for illustrative purposes only and are not in any way limitative. It is to be understood that the scope of the invention is defined by the appended claims rather than by the specification and that various alterations and modifications within the definition and scope of the claims are included in the claims.

What is claimed is:

1. In melting aluminum containing impurities and solidifying the molten aluminum with the result of impurities being released in combination therewith a process for purifying aluminum comprising the steps of breaking down dendrites extending from the interface between the liquid phase and the solid phase of aluminum into the liquid phase by ultrasonic vibration to release impurities from between the dendrites or between the branches of the dendrites in the liquid phase, dispersing the released impurities in the entire body of the liquid phase by mechanically stirring the liquid phase to keep the interface smooth, and extracting only the highly purified aluminum.

2. A process as defined in claim 1 wherein the ultrasonic vibration is given to the dendrites continuously.

3. A process as defined in claim 1 wherein the ultrasonic vibration is given to the dendrites intermittently.

4. A process as defined in claim 1 wherein the liquid phase is stirred by a stirrer immersed in the liquid phase.

5. A process as defined in claim 1 wherein the liquid phase is stirred by the rotation of a seed crystal having a lower end immersed in the liquid phase.

* * * * *